United States Patent [19]

Nakajima et al.

[11] 4,071,005

[45] Jan. 31, 1978

[54] INTERNAL COMBUSTION ENGINE EQUIPPED WITH IMPROVED EXHAUST GAS RECIRCULATION SYSTEM

[75] Inventors: Yasuo Nakajima, Yokosuka; Yoshimasa Hayashi, Yokohama, both of Japan

[73] Assignee: Nissan Motor Co., Ltd., Japan

[21] Appl. No.: 712,279

[22] Filed: Aug. 6, 1976

[30] Foreign Application Priority Data

Aug. 12, 1975 Japan ..... 50-97138

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,882,837 | 5/1975 | Horie et al. | 123/119 A |
| 3,901,202 | 8/1975 | Hollis et al. | 123/119 A |
| 3,970,061 | 7/1976 | Caldwell | 123/119 A |
| 3,981,283 | 9/1976 | Kaufmann | 123/119 A |
| 4,004,559 | 1/1977 | Itoh | 123/119 A |

*Primary Examiner*—Wendell E. Burns

[57] ABSTRACT

A conduit connecting the intake and exhaust systems of an internal combustion engine is equipped with a control valve for controlling the amount of exhaust gases passing through the conduit. A venturi portion constituting part of a Laval nozzle is provided to a portion of the conduit between the control valve and the intake system of the engine.

9 Claims, 3 Drawing Figures

INTERNAL COMBUSTION ENGINE EQUIPPED WITH IMPROVED EXHAUST GAS RECIRCULATION SYSTEM

This invention relates to an internal combustion engine equipped with an exhaust gas recirculation system for recirculating a portion of the exhaust gases to the combustion chamber of the engine.

In connection with an exhaust gas recirculation system of an internal combustion engine wherein a portion of exhaust gases is supplied to the combustion chamber of the engine through the intake system for the purpose of reducing the emission level of nitrogen oxides (NOx), a conduit connecting the intake and the exhaust systems of the engine is usually equipped with a control valve which is operated to vary the cross-sectional area defined between its valve head and its valve seat in response to an engine operating parameter such as intake manifold vacuum modified by venturi vacuum or back-pressure of the exhaust gases to control the amount of the exhaust gases recirculated to the combustion chamber.

However, the above-described control valve has encountered a difficulty wherein unnecessarily excessive amounts of exhaust gases are unavoidably recirculated to the combustion chamber during, for example, deceleration of the engine although the emission level of NOx is very low during the deceleration. This excessive amount of exhaust gas recirculation results from an excessively high pressure differential between the upstream and downstream sides of the control valve, which high pressure is produced by the effect of a closed throttle valve of a carburetor of the engine.

It is, therefore, a main object of the present invention to provide an improved internal combustion engine capable of recirculating an appropriate amount of the exhaust gases to the combustion chamber regardless of variation of the pressure differential between the intake system and the exhaust system of the engine.

Another object of the present invention is to provide an internal combustion engine equipped with an improved exhaust gas recirculation system in which the amount of the exhaust gases recirculated to the combustion chamber is maintained constant when the pressure differential between the intake and exhaust system exceeds a predetermined level.

A further object of the present invention is to provide an internal combustion engine equipped with an improved exhaust gas recirculation system in which a venturi portion constituting part of a so-called Laval nozzle is provided to a part of a conduit connecting the intake system and the exhaust system of the engine.

Other objects and features of the improved internal combustion engine according to the present invention will become more apparent from the following description with the accompanying drawing, in which.

Figure 1:
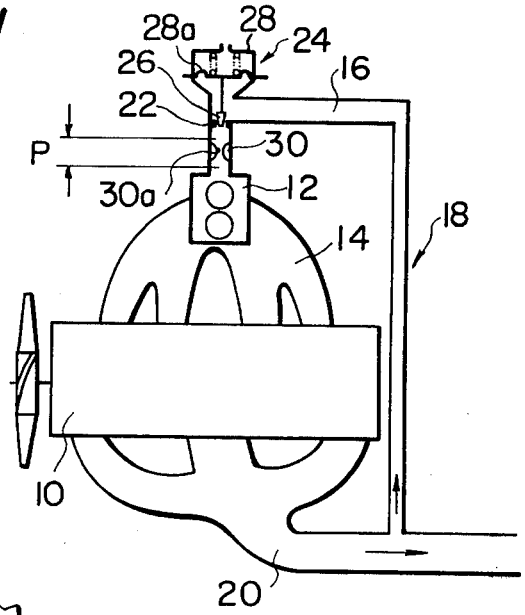
FIG. 1 is a schematical illustration of a preferred embodiment of an internal combustion engine equipped with an exhaust gas recirculation system, in accordance with the present invention.
Figure 2:
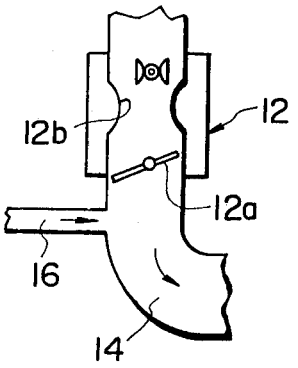
FIG. 2 is a schematic vertical section of a carburetor of the engine of FIG. 1.

Referring now to FIGS. 1 and 2 of the drawing, there is shown a preferred embodiment of an internal combustion engine in accordance with the present invention, in which an engine proper is designated by the reference numeral 10. The engine proper 10 has, as usual, a combustion chamber or combustion (not shown). The combustion chamber is communicated with a carburetor 12 through an intake manifold 14 for an intake passage forming part of intake system of the engine 10. The carburetor 12 has, as customary, a throttle valve **12*a*** within the air-fuel mixture induction passage thereof.

A conduit 16 or conduit means forming part of exhaust gas recirculation system 18 or exhaust gas recirculating means connects a portion downstream of the throttle valve **12*a* of the carburetor 12 to an exhaust passage 20 communicating downstream of the combustion chamber and forming part of the exhaust system of the engine. The exhaust gas recirculation system 18 is arranged to recirculate or supply a portion of the exhaust gases passing the exhaust passage 20 into the combustion chamber through the intake passage 14**.

Disposed inside of the conduit 16 is a valve seat 22 forming part of a control valve 24 or control valve means. The valve seat 22 has an opening (no numeral) therethrough. Disposed insertable into the valve seat opening is a cone-shaped valve head 26 connected to a diaphragm **28*a* of a diaphragm actuator 28. The diaphragm 28*a* is normally urged by a spring (no numeral) in the direction to cause the valve head 28 to insert into the valve seat opening and contact with the valve seat, and moved in the direction to separate the valve head 26 from the valve seat 22 in response to a venturi vacuum applied thereto. Accordingly, the control valve 24 is arranged to vary the cross-sectional area of the opening of the conduit 16 or the cross-section area formed between the valve head 26 and the valve seat 22 to control the amount of the exhaust gases passing through the conduit 16 in response to an engine operating parameter such as the venturi vacuum generated at the venturi portion 12*b* of the carburetor 12, since an amplified venturi vacuum is applied to the diaphragm 28*a*** in this case. The engine operating parameter may be a pressure differential between the intake and exhaust systems of the engine, or an intake manifold vacuum modified by the venturi vacuum or exhaust gas back-pressure.

A venturi portion 30 is formed within the conduit 16 downstream of the valve seat 22. The venturi portion 30 is designed and arranged such that exhaust gases flow through the throat **30*a* of the venturi portion 30 at a velocity of sound when the pressure differential P between the upstream and downstream sides of the venturi portion 30 reaches to a predetermined pressure $P_1$ lower than a particular pressure which is the minimum level for obtaining the gas flow at the velocity of sound. This venturi portion 30** is called or constitutes part of a Laval nozzle which generally has a characteristic wherein the flow of a compressive fluid at the velocity of sound is obtained at its throat when a pressure differential between the upstream and downstream of the throat exceeds a predetermined pressure corresponding to that $P_1$.

It will be understood that the maximum flow speed of the exhaust gases passing through the venturi portion 30 becomes constant at the velocity of sound even when the pressure differential between the upstream and downstream sides of the venturi portion 30 increases over the predetermined level $P_1$. Of course, a super-sonic velocity may be obtained at the venturi portion 30 by applying an extremely high pressure differential to the venturi portion. However, such a high pressure differential will not be applied to the exhaust gas recirculation system 18 of usual internal combustion engines and therefore there is no need of apprehension to generation of the super sonic velocity.

While only the venturi portion 30 formed downstream of the control valve 24 has shown and described, it will be understood that the venturi portion 30 may be located at any portion of the conduit 16, such as upstream of control valve 24, or adjacent the valve seat 22 within the control valve 24.

With the arrangement described hereinbefore, when the pressure differential P between the upstream and downstream sides of the venturi portion 30 is lower than the predetermined level $P_1$, the amount of the exhaust gases recirculated to the combustion chamber through the venturi portion 30 is varied in response to the pressure differential P and the cross-sectional area defined between the valve seat 22 and the valve head 26. However, when the pressure differential P exceeds the predetermined level $P_1$, the flow speed of the exhaust gases flowing adjacent the venturi portion 30 becomes the velocity of sound and therefore the constant flow speed is obtained regardless of variation of the pressure differential P between the upstream and downstream sides of the venturi portion 30. It will be appreciated that the maximum amount of the exhaust gases recirculated to the combustion chamber is the product of the velocity of sound and the cross-sectional area defined between the valve seat 22 and the valve head 26. Furthermore, the maximum amount of the exhaust gases recirculated is maintained constant, if the control valve 24 is operated or opened to cause more amounts of the exhaust gases to flow through the venturi portion 30.

Experiments reveal that the venturi portion 30 is preferably designed so as to obtain the gas flow at the velocity of sound when the pressure differential P reaches about a pressure $P_1$ of 100 mmHg in order to prevent the recirculation of excessive amounts of exhaust gases into the combustion chamber of the engine, which excessive exhaust gas recirculation results from an extremely high vacuum generated during, for example, deceleration of the engine wherein the throttle valve 12*a* of the carburetor 12 is closed.

Figure 3:
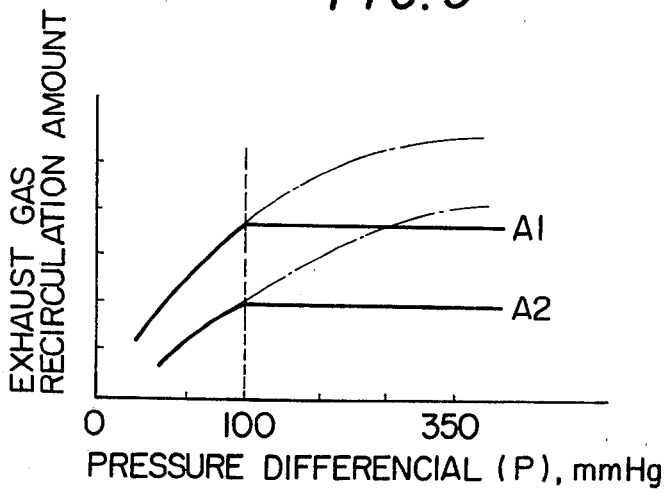
FIG. 3 is a graph showing the variations of the exhaust gas recirculation amount to the pressure differential applied to a Laval nozzle provided to the exhaust gas recirculation system of FIG. 1.

FIG. 3 shows experimental data illustrating the variation of the exhaust gas amount recirculated to the combustion chamber to the pressure differential P between the upstream and downstream sides of the venturi portion 30, wherein curves A1 and A2 respectively represent the data at larger and smaller cross-sectional area defined between the valve seat 22 and the valve head 26. As seen in this Figure, the amount of the exhaust gases recirculated to the combustion chamber becomes constant when the pressure differential P applied to the venturi portion 30 exceeds the predetermined level $P_1$ (100 mmHg).

As is apparent from the foregoing discussion that, according to the present invention, the maximum amount of the exhaust gases recirculated to the combustion chamber is controlled constant at a certain level, since the speed of the flow of the exhaust gases passing through the Laval nozzle disposed within the conduit of the exhaust gas recirculation system is regulated to the velocity of sound when the pressure differential between the upstream and downstream sides of the Laval nozzle is over a predetermined level. Accordingly, excessive amounts of the exhaust gases are not recirculated to the combustion chamber due to an extremely high pressure differential between the intake and exhaust systems of the engine, and therefore an appropriate amount of the exhaust gases can be recirculated to the combustion chamber in response to varying engine operating conditions.

What is claimed is:

1. An internal combustion engine having a combustion chamber therein, comprising:

an intake system including an intake passage for passing therethrough at least air to the combustion chamber of the engine;

an exhaust system including an exhaust passage for passing therethrough the exhaust gases discharged from the combustion chamber;

exhaust gas recirculating means for recirculating a portion of the exhaust gases passing through the exhaust system into the combustion chamber through the intake system, said exhaust gas recirculating means including conduit means connecting the intake system and the exhaust system, and control valve means disposed in said conduit means for controlling the amount of the exhaust gases passing therethrough by varying the opening degree of said control valve means in response to an engine operating parameter; and a constant area venturi portion disposed within a portion of said conduit means and spaced apart from said control valve means of said exhaust gas recirculating means, said venturi portion constituting part of a Laval nozzle which is capable of causing exhaust gases passing therethrough to flow at the velocity of sound when the pressure differential between the upstream and downstream sides thereof is within a predetermined range, said control valve means effective for control of exhaust gas flow when said pressure differential is without said predetermined range.

2. An internal combustion engine as claimed in claim 1, in which the lower limit of said predetermined range is a pressure of 100 mmHg.

3. An internal combustion engine as claimed in claim 1, in which said portion is located downstream of said control valve means.

4. An internal combustion engine as claimed in claim 1, in which said intake system further includes a carburetor connected to said intake passage.

5. An internal combustion engine as claimed in claim 4, in which said conduit means of said exhaust gas recirculating means connects said exhaust passage of the exhaust system to a portion of the intake system downstream of the throttle valve of said carburetor.

6. An internal combustion engine as claimed in claim 5, in which said control valve means includes a valve seat disposed inside of the conduit means, a valve head movably disposed within said conduit means and contactable with said valve seat, and a diaphragm actuator for actuating the valve head in response to a vacuum produced at a portion of the engine, including a diaphragm which is normally urged by a spring in the direction to cause said valve head to contact with said valve seat and movable in the direction to separate the valve head from the valve seat in response to the vacuum applied thereto, said valve head being connected to said diaphragm.

7. An internal combustion engine as claimed in claim 6, in which said valve seat has an opening therethrough, and said valve head is formed into a cone-shape and disposed insertable into the opening of said valve seat to be contactable with said valve seat.

8. An internal combustion engine as claimed in claim 6, in which said vacuum is an amplified venturi vacuum, the venturi vacuum being produced at the venturi portion of said carburetor.

9. An internal combustion engine having a combustion chamber therein, comprising:

an intake system including an intake passage for passing therethrough at least air to the combustion chamber of the engine;

an exhaust system including an exhaust passage for passing therethrough the exhaust gases discharged from the combustion chamber;

exhaust gas recirculating means for recirculating a portion of the exhaust gases passing through the exhaust system into the combustion chamber through the intake system, said exhaust gas recirculating means including conduit means connecting the intake system and the exhaust system, and control valve means for controlling the amount of the exhaust gases passing therethrough by varying the opening degree of said control valve means in response to an engine operating parameter, said control valve means including a valve seat disposed inside of said conduit means, a valve head seatable on said valve seat, and a diaphragm actuator for actuating the valve head in response to a vacuum produced at a portion of the engine; and a constant area venturi portion disposed inside of a portion of said conduit means and spaced apart from the valve seat of said control valve means, said venturi portion constituting part of a Laval nozzle which is capable of causing exhaust gases passing therethrough to flow at the velocity of sound when the pressure differential between the upstream and downstream sides thereof is within a predetermined range, said control valve means effective for control of exhaust gas flow when said pressure differential is without said predetermined range.

* * * * *